US012790769B2

(12) United States Patent
Knutson et al.

(10) Patent No.: US 12,790,769 B2
(45) Date of Patent: Nov. 10, 2026

(54) COMPACTION ROLLER WITH DRUM SCRAPER

(71) Applicant: Wacker Neuson America Corporation, Menomonee Falls, WI (US)

(72) Inventors: Donovan Knutson, Slinger, WI (US); Tyler Johnson, Wauwatosa, WI (US)

(73) Assignee: Wacker Neuson America Corporation, Menomonee Falls, WI (US)

( * ) Notice: Subject to any disclaimer, the term of this patent is extended or adjusted under 35 U.S.C. 154(b) by 297 days.

(21) Appl. No.: 18/752,067

(22) Filed: Jun. 24, 2024

(65) Prior Publication Data

US 2025/0389090 A1 Dec. 25, 2025

(51) Int. Cl.
*E01C 19/28* (2006.01)
*E01C 19/23* (2006.01)

(52) U.S. Cl.
CPC ..... *E01C 19/282* (2013.01); *E01C 19/238* (2013.01)

(58) Field of Classification Search
CPC ..... E01C 19/238; E01C 19/282
USPC ..... 404/72–75, 120–132
See application file for complete search history.

(56) References Cited

U.S. PATENT DOCUMENTS 3,891,342 A * 6/1975 Roe ..... E02F 3/964 37/444
4,490,070 A * 12/1984 Upchurch ..... E02D 3/032 404/121
4,523,873 A * 6/1985 Elliot ..... E01C 19/285 172/554
4,732,507 A 3/1988 Artzberger
5,082,396 A 1/1992 Polacek
5,934,824 A 8/1999 Vural
7,059,802 B1 * 6/2006 Geier ..... E01C 19/286 404/117
7,066,682 B2 * 6/2006 Hester ..... E02F 3/961 404/124
8,328,464 B2 12/2012 Sina et al.
8,585,317 B1 11/2013 Sina
9,267,245 B1 2/2016 Braun
9,334,612 B2 5/2016 Marshall et al.
9,593,453 B2 3/2017 Halimi et al.
10,047,500 B2 * 8/2018 Geier ..... E01C 19/262
(Continued)

FOREIGN PATENT DOCUMENTS

EP 2085519 A2 1/2009

*Primary Examiner* — Raymond W Addie
(74) *Attorney, Agent, or Firm* — Boyle Fredrickson, S.C.

(57) ABSTRACT

A compaction roller machine has a chassis that is connected to at least one driven roller assembly. The roller assembly includes a stationary casing and a rotatable drum that rotates with an axle extending through the casing. The drum includes a central flange and an outer shell connected to the flange by a radial support. A scraper is mounted on an outside surface of the casing in proximity to an interface between the radial support and the inner peripheral surface of the shell. The scraper is configured to scrape debris from the drum and to break up debris located between it and the adjacent radial support. The machine may be a vibratory roller with a driven drum that also is excited to vibrate, in which case the roller assembly additionally includes a roller assembly drive motor and an exciter assembly drive motor supported on an outside surface of the casing.

20 Claims, 9 Drawing Sheets

(56) References Cited

U.S. PATENT DOCUMENTS

| | | | | |
|---|---|---|---|---|
| 2014/0205380 | A1 | 7/2014 | Geier | |
| 2015/0110557 | A1* | 4/2015 | Dykhnich | E02D 3/026 404/121 |

* cited by examiner

COMPACTION ROLLER WITH DRUM SCRAPER

BACKGROUND OF THE INVENTION

1. Field of the Invention

The present invention relates to a compaction roller machine that includes one or more rollers or drums that compact soil, etc. and, more particularly, relates to a compaction roller machine having a scraper that scrapes debris from an interior surface of a drum of the machine. The invention additionally relates to a method of operating such a machine.

2. Discussion of the Related Art

Compaction roller machines, sometimes called "compaction rollers" or simply "rollers," are widely used to compact soil t, etc. Compaction roller machines range from relatively large riding machines, to smaller remote controlled walk machines, to walk-behind, manually steered machines. Such machines include at least one driven roller assembly supporting a frame and other components, including the machine's prime mover, typically an internal combustion ("IC") engine or electric motor. The roller assembly includes a rotating drum that is connected to a stationary support that, in turn, is connected to the machine's frame. At least one roller of these machines often is excited to vibrate by an exciter assembly in operative engagement with the drum of the roller assembly. These machines typically are referred to as "vibratory compaction rollers" or simply "vibratory rollers".

One type of vibratory roller is a vibratory trench roller, which typically is used to compact backfilled trenches after a pipeline is laid or to compact the floor of a trench prior to laying a pipeline. The typical vibratory trench roller includes a chassis supported on the surface to be compacted by two roller assemblies, each of which supports a respective subframe of the chassis. The subframes may be articulated to one another by a pivot connection. Each of the roller assemblies typically includes a stationary axle housing or transmission casing that surrounds an axle which is driven to rotate by a dedicated hydraulic motor. A ground-engaging drum is connected to the axle so as to rotate with the axle. All of the hydraulic motors are supplied with pressurized hydraulic fluid from a pump powered by an IC engine or electric motor mounted on one of the subframes.

In addition, each drum is excited to vibrate by a dedicated exciter assembly that is located within the associated axle housing or transmission casing and that is powered by a hydraulic motor connected to the pump. The exciter assembly typically comprises one or more eccentric masses mounted on a rotatable shaft positioned within the transmission casing. The exciter assembly typically comprises one or more eccentric masses that rotate with the shaft. The exciter assembly in widest use today is composed of two synchronized counter-rotating shafts, each of which bears one or more eccentric weights. The shafts are operationally mated to one another via two intermeshing gears. A first one of the shafts is driven by a hydraulic motor or similar drive, and the other shaft is driven by the first shaft via operation of the intermeshing gears. This arrangement allows the forces produced by each shaft to cancel each other in the horizontal plane but complement each other in the vertical plane. The resulting force is more effectively transmitted to the ground and also reduces the vibrations transmitted to the rest of the machine.

Machine propulsion, vibration, and other operational characteristics are controlled by a remote controller positioned a safe distance from the machine and in RF or IR communication with the machine. Examples of this type of vibratory trench roller machine are disclosed, for example, in U.S. Pat. Nos. 8,328,464 and 7,059,802, both assigned to Applicant, and the subject matter of both of which is incorporated herein in its entirety by reference.

Mud, chunks of concrete, pebbles, and other debris can make their way into the drums of the roller assemblies of vibratory trench rollers and other compaction rollers. Such debris can accumulate in the inner peripheral surface of the drum, risking damage to hydraulic hoses, motors, and other components located in the drum. The risk of damage can be reduced by mounting at least some of these at-risk components in the transmission casing, but this hinders maintenance by requiring more complete disassembly of the roller assembly to access the components. Space constraints on smaller machines, such as vibratory trench rollers, also hinder the mounting of such components in the transmission casing.

The need therefore has arisen for a robust compaction roller machine having a roller assembly that is relatively easy to manufacture, assemble, and maintain and yet is durable and has low risk of damage from debris inside the drum.

The need also has arisen to provide a mechanism for preventing the buildup of debris inside the drum of a roller assembly of a compaction roller machine.

The need also has arisen to provide a method of operating a compaction roller machine in a manner that reduces the buildup of materials in locations of the machine's roller assembly or assemblies that risks damage to sensitive components of the roller assembly.

SUMMARY

In accordance with a first aspect of the invention, one or more of these needs are met by providing a compaction roller machine with a scraper that scrapes debris from the inner peripheral surface of the drum of a roller assembly of the machine. The scraper may be configured to break up larger chunks of debris and to facilitate the passage of debris out of the roller assembly.

More specifically, a compaction roller machine is provided having a chassis that is connected to at least one roller assembly. The chassis supports a prime mover, such as an IC engine or an electric motor. The roller assembly includes a rotatable axle and drum that rotates with the axle. The drum includes a central flange that is affixed to the axle and an outer shell that is connected to the flange by a radial support. A stationary casing is located radially between the axle and the shell. A scraper is mounted on an outside surface of the casing in proximity to an interface between the radial support and the inner peripheral surface of the shell. The scraper is configured to scrape debris from the drum and to break up debris located between it and the adjacent radial support.

The compaction roller may be a vibratory roller with a driven drum that also is excited to vibrate, in which case the roller assembly additionally includes a roller assembly drive motor and an exciter assembly drive motor supported on an outside surface of the casing.

The compaction roller machine may comprise a remote-controlled vibratory trench roller having front and rear roller assemblies, each of which supports an associated subframe of an articulated chassis.

Each of the front and rear roller assemblies may have a split drum assembly having first and second coaxial drums. A single drive axle may be provided for both drums. The drive motor(s) and scraper may both be located in one of the drums, with the scraper being located adjacent the radial support of the associated drum.

The radial support may be formed from a number of spokes that extend at least generally radially between the flange and the shell. The other end of each spoke may be reinforced with gussets. The scraper may be positioned so as to be closely adjacent each gusset at that gusset's point of closest approach to the scraper during drum rotation.

Also disclosed is a method of operating a compaction roller machine constructed in at least generally the manner described above.

These and various other aspects, advantages, and features of the invention will become apparent to those skilled in the art from the following detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

An exemplary embodiment of the invention is illustrated in the accompanying drawings in which like reference numerals represent like parts throughout, and in which.

DETAILED DESCRIPTION

Figure 1:
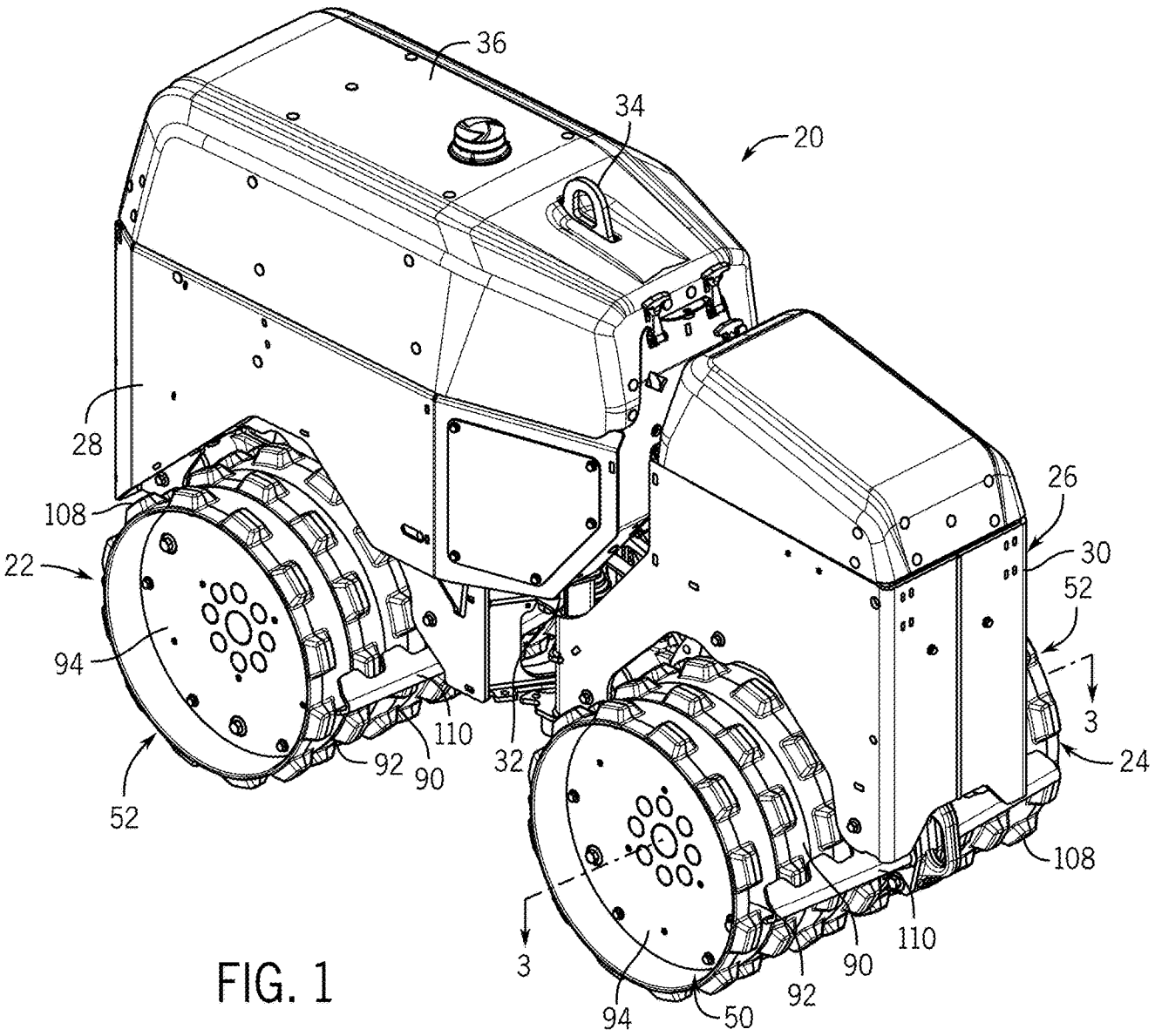
FIG. 1 is an isometric view of a compaction roller machine equipped with a roller assembly constructed in accordance with an embodiment of the present invention.
Figure 2:
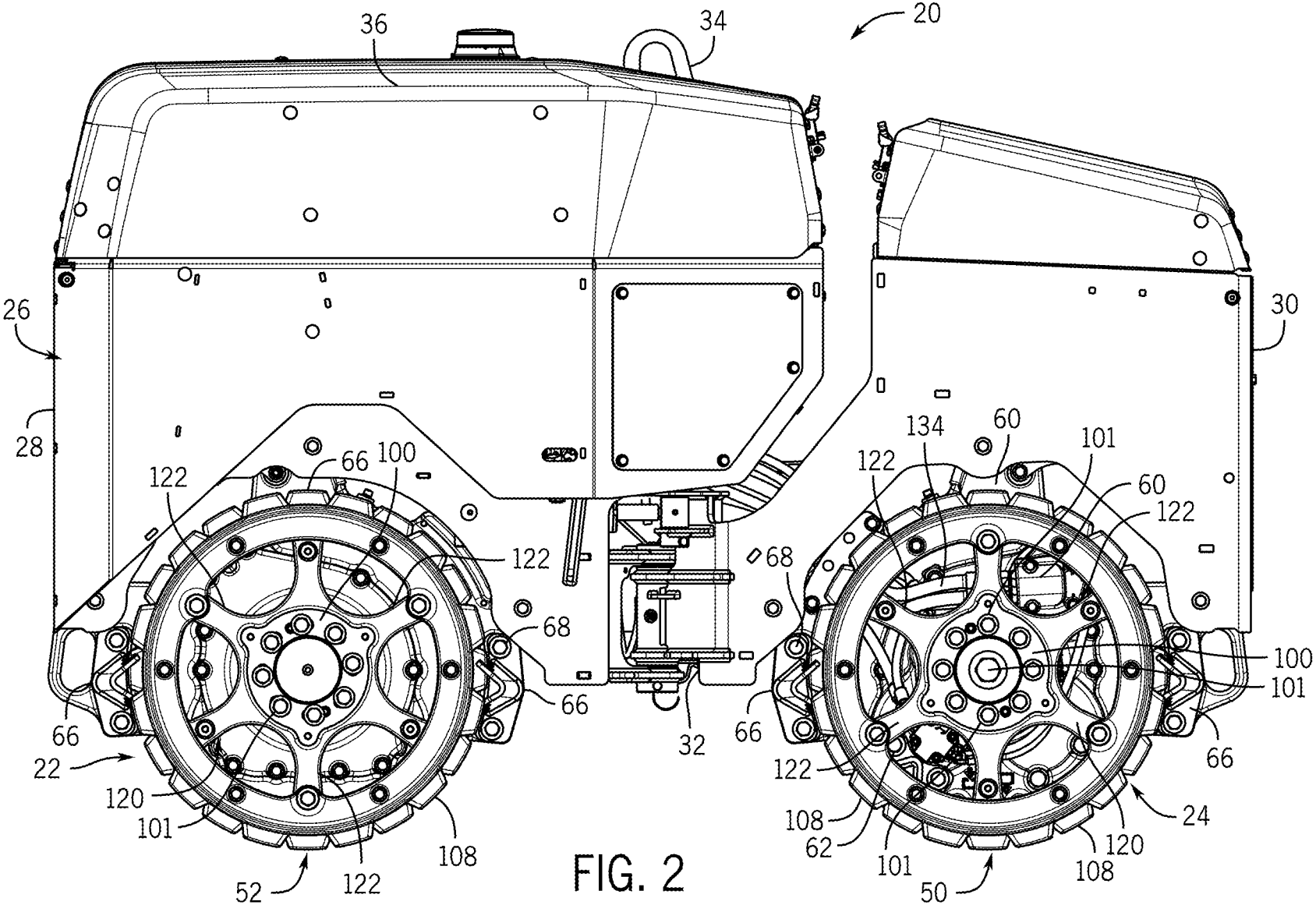
FIG. 2 is a side elevation view of the compaction roller machine illustrated in FIG. 1.

FIGS. 1 and 2 illustrate a compaction roller machine 20 constructed in accordance with an embodiment of the present invention. The invention is generally applicable with a variety of compaction machines ranging from riding rollers for ground compaction, to walk-behind rollers to remote-controlled rollers. Many aspects of the invention are applicable to either vibrating rollers or non-vibrating rollers. Hence, while an example of a compaction roller machine 20 in the form of remote-controlled vibratory trench roller now will be described, it should be understood that the invention is applicable to a variety of other compaction roller machines as well.

The vibratory trench roller 20 of FIGS. 1 and 2 is a self-propelled machine supported on the ground via rear and front rotating roller assemblies 22 and 24. The machine 20 comprises an articulated chassis 26 having front and rear subframes 28 and 30 connected to one another via a pivot connection 32. The chassis 26 is about 0.5 meters (20 in) wide. This narrow width is important to permit the roller 20 to be used to compact the bottom of trenches for laying pipeline and the like. The trench roller 20 can be lifted for transport or deposited in a trench whose floor is to be compacted by connecting a chain or cable to a lift eye 34 located on the front subframe 28. The front subframe 28 supports a prime mover (not shown) accessible via a pivoting hood 36. The prime mover is an internal combustion engine in this embodiment but could be an electric motor or other motive power source. The prime mover supplies motive power to a pump (also not shown) that generates hydraulic pressure and flow used to drive all hydraulically powered components of the trench roller 20. The prime mover, pump, and related components may be standard for machines of this type and, accordingly, need not be described in greater detail herein.

Figure 4:
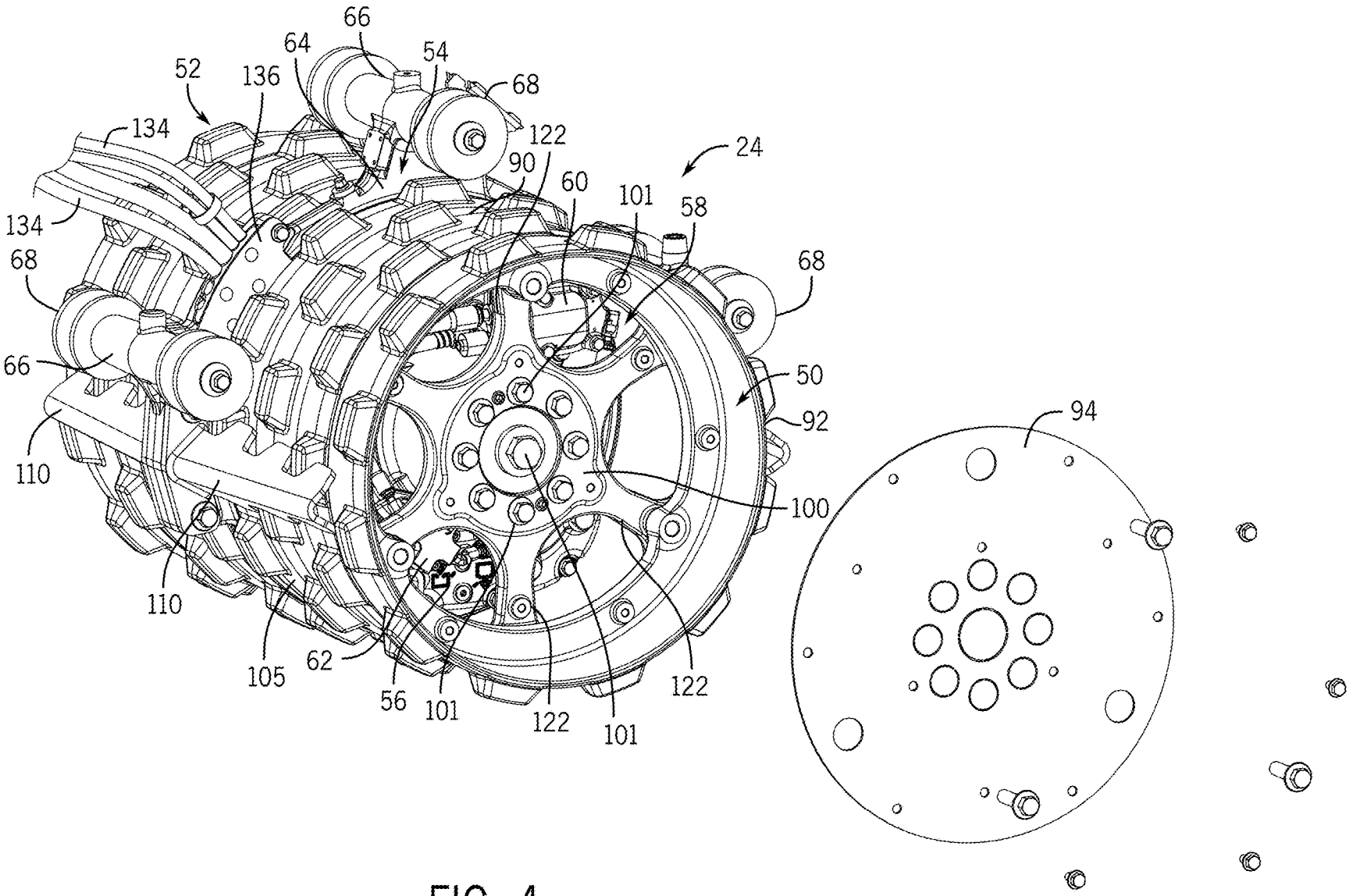
FIG. 4 is a partially exploded isometric view of the roller assembly of FIG. 3.

Still referring to FIGS. 1 and 2, each of the subframes 28 and 30 is attached to a respective one of the front and rear roller assemblies 22 and 24. The roller assemblies 22 and 24 are of identical construction and are mirror images of each other. Hence, the drive motors and scraper described below are mounted on the right side of the front roller assembly 22 and the left side of the rear roller assembly 24. The roller assemblies 22 and 24 are typically of equal diameter. That diameter may vary from 2 m for large rollers to about 0.5 m for the illustrated vibratory trench roller. Each roller assembly 22 and 24 has a longitudinal length of about 0.55 m, extendible to about 0.84 m with the addition of extender drum sections described below. Each roller assembly 22 and 24 is excited to vibrate by an exciter assembly and driven to rotate by a hydraulically powered drum drive assembly 58 (FIGS. 4 and 6). In accordance with an aspect of the invention, a scraper 200 (FIGS. 5-11) is provided in each roller assembly 22 and 24.

The rear roller assembly 24 now will be described, it being understood that the description applies equally to the front roller assembly 22 with the exception that the front roller assembly 22 is a mirror image of the rear roller assembly 24 in that the assembled roller assembly 24 is rotated 180 deg. about the articulation joint.

Figure 3:
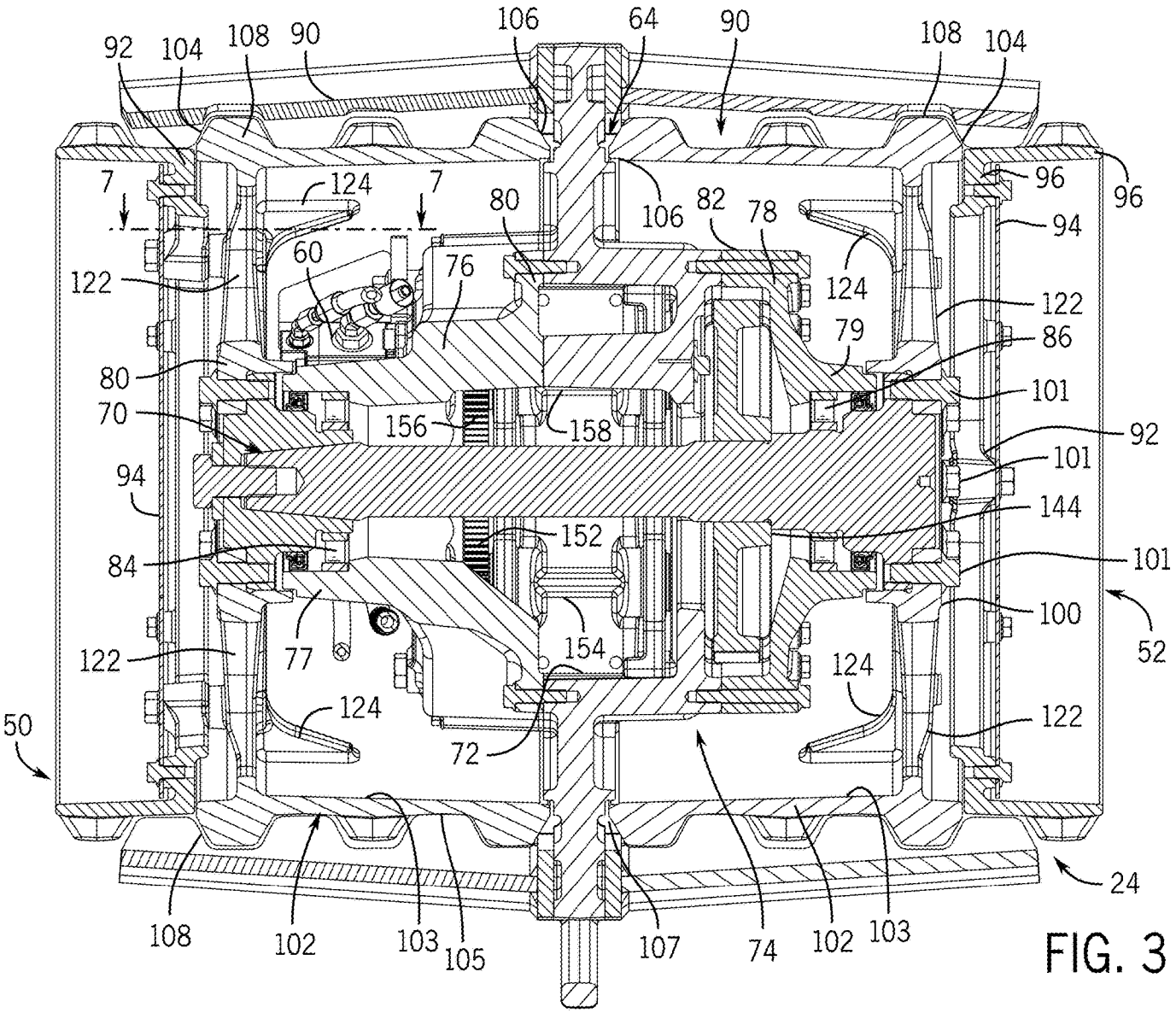
FIG. 3 is an axial sectional view of one of the roller assemblies of the compaction roller machine of FIGS. 1 and 2, taken generally along the line 3-3 in FIG. 1.

Turning now to FIGS. 3 and 4, the roller assembly 24 is a so-called split roller assembly having left and right rotating drums 50 and 52 located end to end and mounted on a stationary central drum support 54. Notably, a single exciter assembly 56 and a single drum drive assembly 58 are provided for the entire roller assembly 24, with the drum drive motor 60, exciter drive motor 62, and scraper 200 (all detailed below) being located in the outboard portion of the left drum 50. The corresponding components are located on the outboard right side of the right drum 52 of the front roller assembly 22 which, as mentioned, is a mirror image of the rear roller assembly 24.

Still referring to FIGS. 3 and 4, the drum support 54 comprises a ring 64 and a plurality (three in this embodiment) of circumferentially-spaced spaced support arms 66 that extend generally radially from the outer peripheral surface of the ring 64. Each support arm 66 bears a respective shock mount 68. The shock mounts 68 collectively support the subframe 30 so as to vibrationally isolate the subframe 30 from the roller assembly 24.

Still referring to FIGS. 3 and 4, an axle 70 extends axially through a center opening 72 in the ring 64 and has a hub 73 (FIGS. 5 and 6) located on each end. Except for the hubs 73, the axle 70 is surrounded by a transmission casing 74. The transmission casing 74 is formed from the ring 64 and first and second (left and right) hollow end caps 76 and 78 extending axially outwardly from the ring 64. Each end cap 76, 78, has an inner flange 80, 82 that is bolted to a respective surface of the ring 64. Each end cap 76, 78 additionally has a tubular intermediate portion and outer axial shoulder 77, 79 with an opening that receives the axle 70. Left and right bearings 84 and 86 rotatably support the respective ends of the axle 70 in the outer shoulder 77 and 79 of the outer end caps 76 and 78 of the transmission casing 74.

Still referring to FIGS. 3 and 4, each drum 50, 52 includes a main drum section 90 and an optional extender section 92 that can be bolted onto the outer axial end of the main drum section 90 to increase the effective compaction width of the roller assembly 24. In this embodiment, in which the entire roller assembly 24 has a maximum axial length of about 0.84 m, the axial length of the main drum section 90 and the extender section 92 are about 0.27 m and about 0.14 m, respectively. Of course, these dimensions may vary dramatically from application to application. A cover 94 is bolted to an annular flange 96 on the extender section 92 (the covers are not shown in FIG. 2), if the extender section 92 is utilized. If not, the cover can be bolted to an annular flange 100 on the main drum section 90 that also serves as a mount for the extender section 92.

Still referring to FIGS. 3 and 4, each main drum section 90 includes the annular flange 100 described above, an outer shell 102, and a radial support 120 connecting the flange 100 to the shell 102. All of these components may be formed from a single steel casting. The flange 100 is bolted to the axle hub 73 by bolts 101 to cause the drum 50 assembly to rotate with the axle 70. The shell 102 has an outer axial end 104, and an inner axial end 106 that is spaced slightly from the outer surface of the ring 64 by gap 107 having a thickness of on the order of 3 mm, which is required to prevent the drum from rubbing against the ring. This gap 107 can be considered an "entrance gap" through which dirt, debris, and other materials may enter and exit the drum 50. The shell has a smooth inner peripheral surface 103 and an outer peripheral surface 105 that is configured to maximize compaction effectiveness. Outer surface 105 is provided with so-called "sheepfoot lugs" 108 in this embodiment. A stationary scraper 110, mounted on the subframe 30, scrapes debris from the outer peripheral surface 105.

The radial support 120 of this embodiment support includes a plurality (six in this example) of circumferentially spaced spokes 122 extending at least generally radially from the flange 100 to the inner peripheral surface 103 of the shell 102. The inner axial side of each spoke 122 is reinforced with a gusset 124 leading from an inner axial surface of an outer radial end portion of the spoke 122 to the inner peripheral surface 103 of the shell 102. Each of the illustrated gussets 124 is generally L-shaped, having a generally radial leg and a generally axial leg. Each gusset 124 forms an interface between the outer end of the spoke 122 and the inner peripheral surface 103 of the shell 102. At least the inner peripheral surface 103 of the shell 102 may be of non-uniform diameter along its axial length. For example, the diameter of surface 103 may taper on the order of 10 mm from outer to inner ends. This taper is a natural result of the casting process, but provides the benefit of creating a ramp that helps channel debris to the entrance gap 107.

Figure 5:
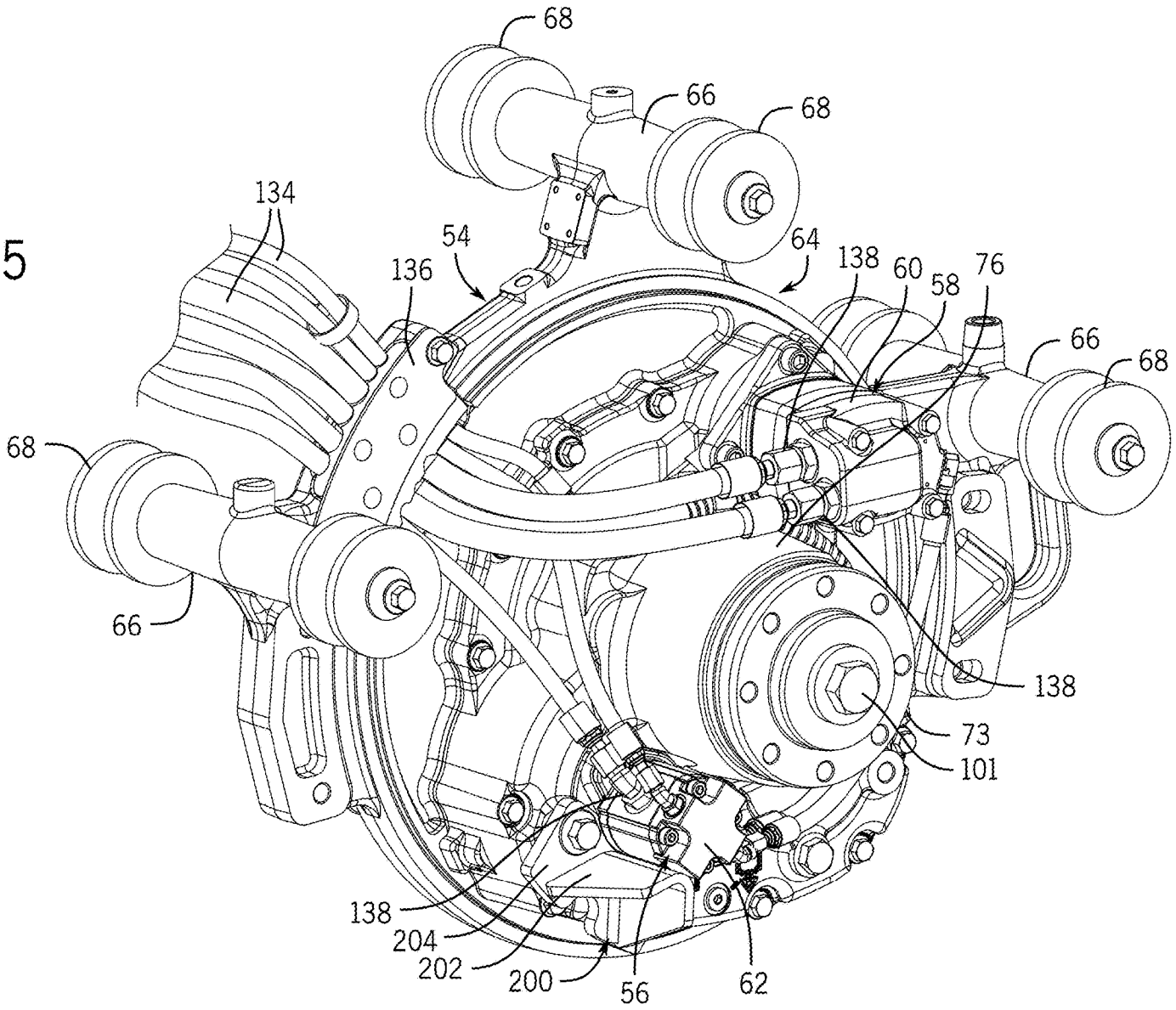
FIG. 5 is an isometric view of the of the roller assembly of FIGS. 3 and 4, with the rotating drums removed.
Figure 6:
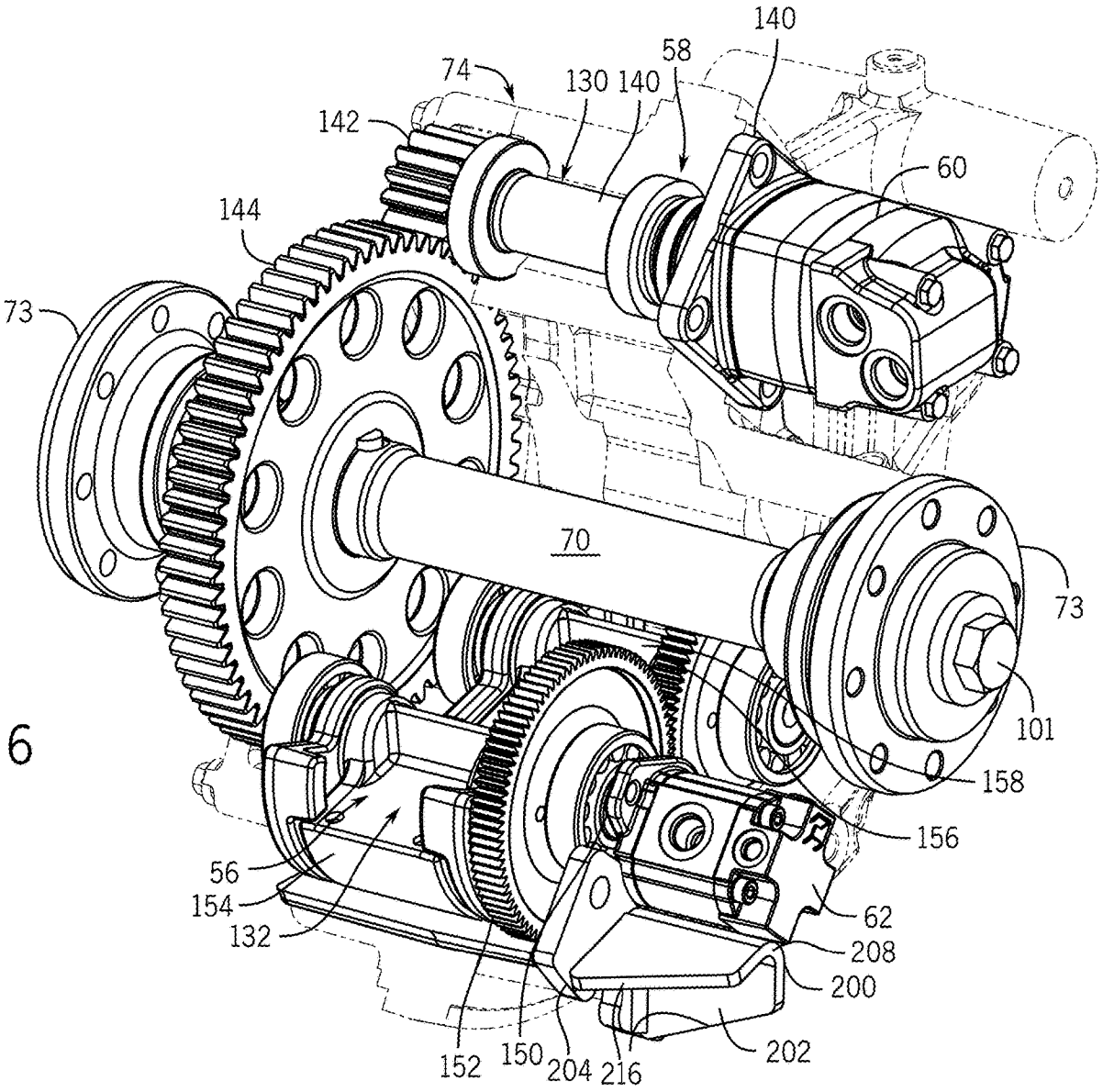
FIG. 6 is a isometric view of the drum drive and excitation systems of the roller assembly of FIGS. 3-5.
Figure 7:
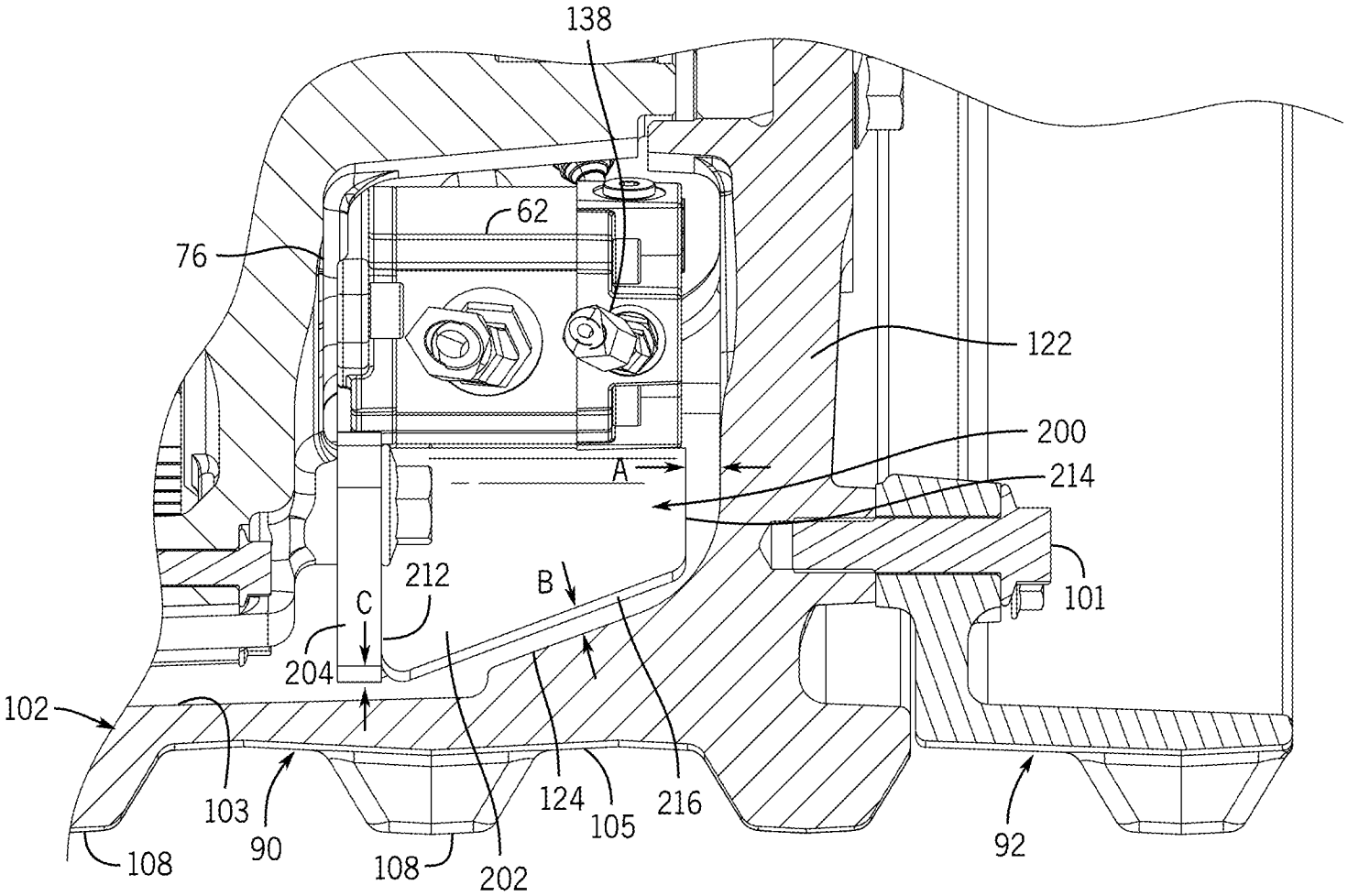
FIG. 7 is a sectional view taken generally along the line 7-7 in FIG. 3.
Figure 8:
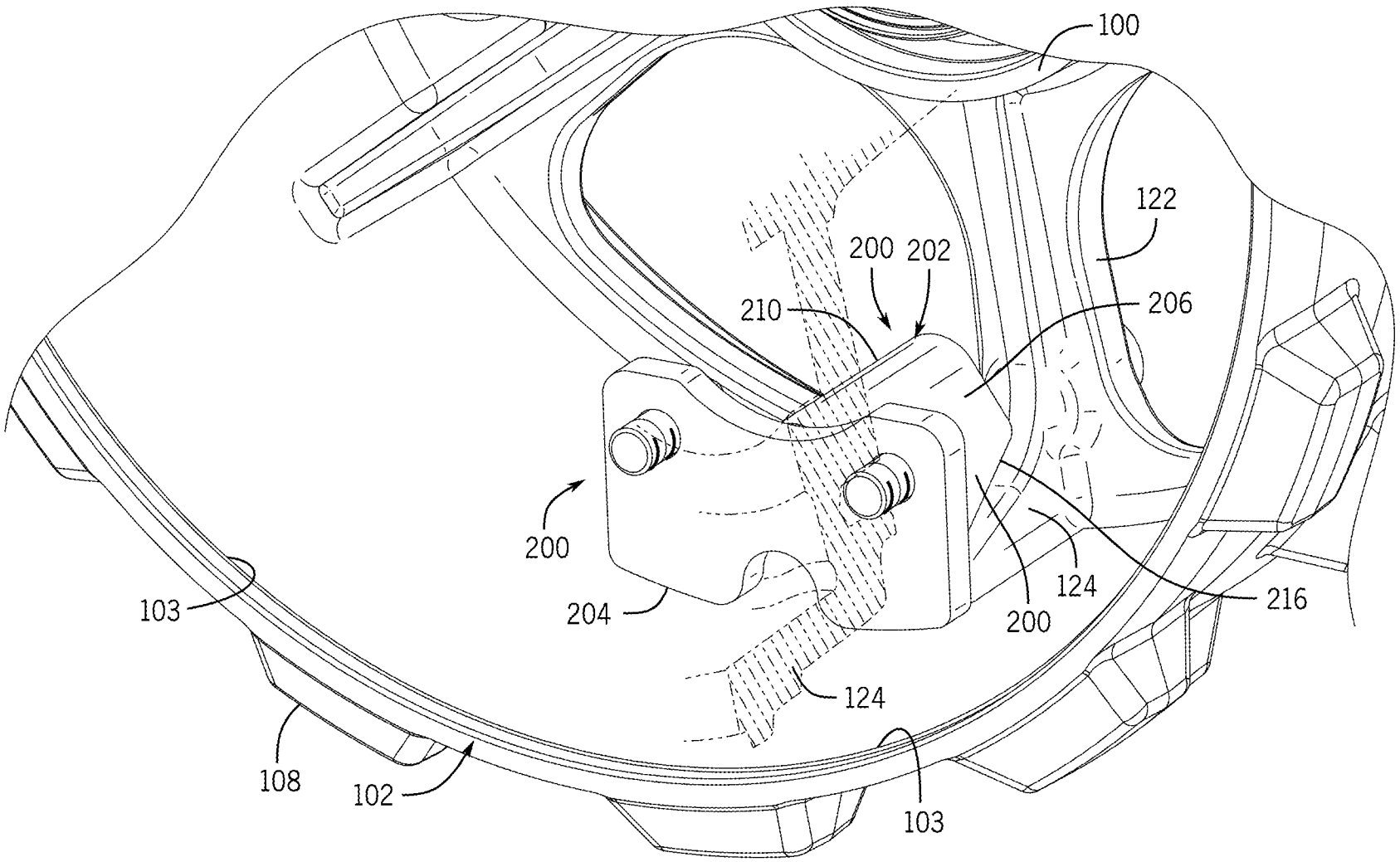
FIG. 8 is an enlarged isometric view showing interaction between the scraper and associated drum components of the roller assembly of FIGS. 3-7.
Figure 9:
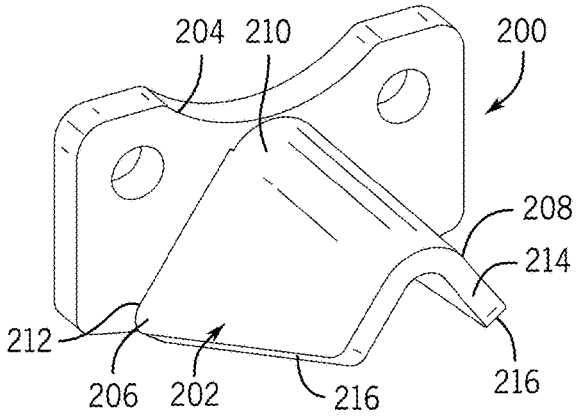
FIGS. 9 and 10 are top and bottom isometric views, respectively, of the scraper of the roller assembly of FIGS. 3-8.
Figure 10:
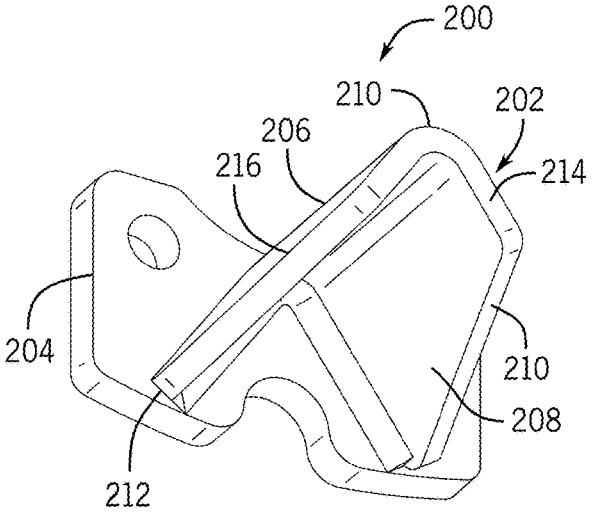
Figure 11:
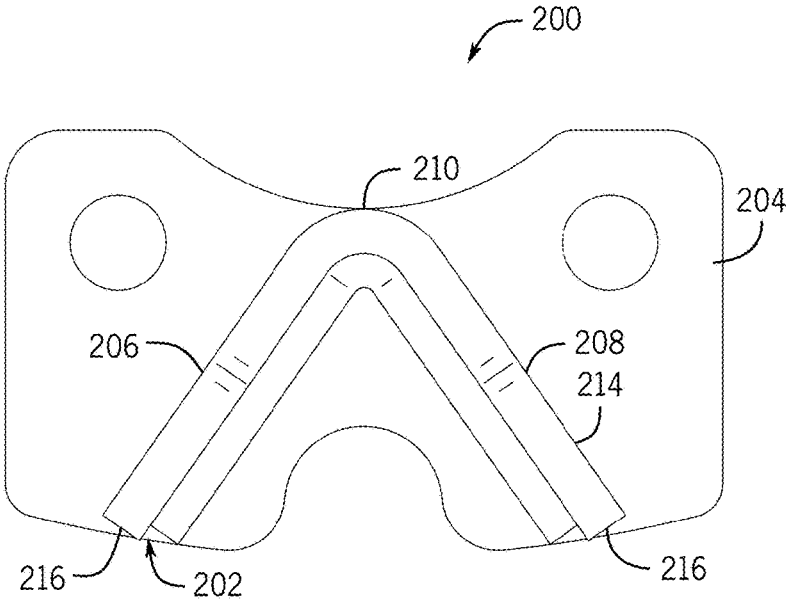
FIG. 11 is an end elevation view of the scraper of FIGS. 9 and 10.

Referring now particularly to FIGS. 3, 5, and 6, the drum drive assembly 58 includes the hydraulic motor 60 and a drivetrain 130 that couples the motor 60 to the axle 70. The exciter assembly 56 similarly includes the exciter drive motor 62 and an exciter 132. Both motors 60 and 62 may be reversible. The drum drive motor 60 and exciter drive motor 62 are mounted on the outside of the end cap 78 of transmission casing 74, while the drivetrain 130 and the exciter 132 are located inside the transmission casing or the space adjacent to it. Hence, the drive motors 60 and 62 and hydraulic connections are easily accessible without having to dismantle the transmission casing 74.

Still referring to FIGS. 3, 5, and 6, the drum drive motor 60 is mounted on the outer axial surface of the transmission casing end cap 76 above the axle 70. The exciter drive motor 62 is mounted on the outer axial surface of the transmission casing end cap 76 below the axle 70, generally diametrically opposite the drum drive motor 60. Hydraulic hoses 134 transfer fluid between both motors 60 and 62 and the machine's hydraulic system. The hoses 134 pass through apertures in a retainer 136, which is mounted on one of the drum support mounting arms 66 These apertures form chases between the interior and the exterior of the drum 50. The hoses 134 are connected to hydraulic fittings 138 on the motors 60 and 62.

Referring now to FIGS. 3 and 6, and to FIG. 6 in particular, the drivetrain 130 is located inside the transmission casing 74. It includes a driven shaft 140 that connects the motor 60 to a pinion 142. The pinion 142 meshes with a drive gear 144 that is fixed to the axle 70 so that drivetrain rotation causes axle rotation. The exciter assembly also is located inside the transmission casing. It includes a driven shaft 150 that drives a first gear 152 and a first exciter 154. The first gear drives a second gear 156 that drives a second exciter 158. Each exciter 154 and 158 includes one or more eccentric masses that generate(s) vibrations as the exciter rotates. If two masses are provided per exciter, the amplitude of the vibrations generated by each exciter can be altered by reversing the direction of exciter rotation.

Referring now to FIGS. 3 and 5-11, and initially to FIGS. 3 and 5-8, the scraper 200 is configured to remove materials that are caked on the inner peripheral surface 103 of the shell 102 outboard of the transmission casing 74. The scraper 200 also may be configured to break up larger pieces of debris by grinding or crushing them between itself and the interfaces between the drum support 120 and the shell. In this embodiment, the interfaces are formed by the gussets 124 on the spokes 122. Finally, the scraper 200 is configured to permit scraped materials to move toward the interior of the drum 50, or from right to left in FIG. 3, where it may fall out of the drum 50 through the entrance gap 107. By keeping the interior of the drum 50 relatively free of debris, the scraper 200 reduces the chances of damage to the motors 60, 62 hoses 134, fittings 138, and other hydraulic components of the roller assembly 24. Drawbacks generally associated with positioning such components outside of the transmission casing are greatly alleviated.

Referring now to FIGS. 3 and 7-11, the scraper 200 includes a scraper body 202 that is welded to a mounting plate 204 which, in turn, is bolted to the outer axial surface of the transmission casing end cap 76. The scraper body 202 has first and second legs 206 and 208 meeting at an apex 210 that is spaced radially from the inner peripheral surface 103 of the shell 102. The included angle between the legs 206 and 208 is typically on the order of 30-90 degrees and, more typically, 78 degrees. Providing two symmetrical legs 206 and 208 provides for equally effective scraping during both forward and reverse rotation of the drum 50. Each leg 206, 208 has inner and outer axial ends 212 and 214 and an outer radial end surface 216. The inner axial end 212 is welded to the mounting plate 204. The outer axial end 214 forms a scraping surface and is in relatively close proximity to the point of closest approach of the radial legs of the gussets 124 during drum rotation, as designated by the "A" in FIG. 7. The outer radial end surface 216 forms another scraping surface. It is inclined along at least the majority of its length at an angle that generally matches that of the generally axial legs of the gussets 124, hence providing for a relatively uniform gap "B" between the outer radial end surface 216 and the adjacent surface of each gusset 124 at that gusset's point of closest approach during drum rotation. The innermost axial end of the outer radial end surface 216, as well as the adjacent outer radial surface of the mounting plate 204, are spaced from the inner peripheral surface 103 of the shell 102 by a gap "C".

The thicknesses of the gaps A, B, and C may vary based on several factors. They should not be so small so as to risk rubbing or interference between the scraper 200 and the adjacent surfaces of the drum 50. They also should be larger than the thickness of the entrance gap 107 (3 mm in this example) so that smaller stones that fit through the entrance gap 107 cannot be caught between the stationary scraper and the adjacent rotating components 102, 120, 124. In addition, setting the gaps A, B, and C to crush material that is smaller than 3 mm would provide no practical purpose because those small pieces of material would be able to work their way back out of the drum 50 during drum rotation without further milling or crushing. Another benefit of positioning the scraper 200 as close to the shell 102 and gussets 124 as possible is that, as the scraper pushes mud and other debris away from the drum, the scraper helps form a clearance between the material stuck to and rotating with the drum and other, stationary components of the roller assembly 24 to help reduce wear that those components otherwise would experience from the abrasive medium.

On the other hand, the maximum thicknesses of gaps A, B, and C should be on the order two to four times the entrance gap (6 mm in the present example) so as not to leave pieces of material that are so large that they do not get ground down/milled sufficiently to escape the drum 50 through the entrance gap 107. Hence, the maximum thicknesses of the gaps A, B, and C should be between 6 and 12 mm.

In the present non-limiting example in which tolerance stackups and other considerations were taken into account when designing the shape and positioning of the scraper 200, the gap thicknesses were set as follows:

A=10.0 mm

B=5.6 mm

C=7.0 mm

Of these, the gap B is the most important as that is the thickness of the "working gap" between the scraper 200 and the gussets 124 where the vast majority of scraping is performed. That "working gap" is less than twice the thickness of the entrance gap 107.

The scraper 200 may be located anywhere within the circumference of the roller assembly 24. Loose materials in the drum 50 tend to tumble during drum rotation, similar to the manner in which laundry tumbles in a clothes dryer. More effective grinding or crushing of loose materials takes place if the scraper 200 is positioned at a location in which loose materials tend to accumulate during drum rotation. That location is in the vicinity of the bottom of the roller assembly 24. The scraper 200 thus typically will be located within 30 degrees, and more typically within 20 degrees, of the bottom of the roller assembly 24.

In operation, the trench roller 20 is placed in a trench or on another area to be compacted. The remote control is then operated to start the engine or other prime mover to activate the exciter drive motors 62 to impart vibrations to the roller assemblies 20 and 24, and activate the drum drive motors 60 to rotate the drums 50 and 52 of each roller assembly 20 and 24 to propel the machine 20 either forward or reverse. The trench roller 20 may be steered by extending or retracting an actuator, typically a hydraulic cylinder, to change the articulation angle between the front and rear subframes 28 and 30. This steering also is controlled remotely.

During operation, dirt, mud, stones, and other debris can enter each drum 50 or 52 through the 3 mm thick entrance gap 107. That debris is harmless in the drum 52 that does not house hydraulic components. However, debris that makes it way beyond the axial outer surface of the transmission casing end cap 76 of the opposite drum 50 tends to pile up in front of the leading edges of the gussets 124, which act as scoops or plows. Dirt and mud also can form large pieces of hardened debris which then have a tendency to tumble within the drum 50, potentially harming the hydraulic components 60, 62, 134, 138. The scraper 200 creates a shearing action between itself and the gussets 124 which helps crush the larger pieces into smaller ones. Being located near the bottom of the roller assembly 24, the scraper 200 is also positioned to engage those tumbling pieces at the location where they accumulate, leading to improved grinding or crushing. Other, caked debris is simply removed from the gussets 124 and the inner peripheral surface 103 of the shell 102 by the scraper 200. The removed debris can then work its way axially toward the ring 64 of the drum support 54 and exit the entrance gap 107 between the ring 64 and the drum 50. This motion is facilitated by the above-described incline of the inner peripheral surface 103 of the shell 102, which causes the shell to act like a ramp directing materials toward the ring.

It should be noted that a second scraper can be placed in the second drum subassembly of one or both of the roller assemblies, if desired. The shape of the scraper also could, and likely would, vary significantly if used in a drum without the gussets or with a different radial support structure. Also, as mentioned above, any compaction roller would be benefitted by a scraper constructed at least generally as described herein, especially a compaction roller having a roller assembly with hydraulic or other components that are prone to damage from debris in the drum. Hence, although the best mode contemplated by the inventors of carrying out the present invention, various additions, modifications and rearrangements of the features of the present invention may be made without deviating from the spirit and the scope of the underlying inventive concept.

We claim:

1. A compaction roller machine comprising:

(A) a frame;

(B) a prime mover that is supported on the frame;

(C) a roller assembly that is attached to the frame, the roller assembly including a stationary casing and a rotating drum which is driven to rotate by the prime mover and in which the casing is located, the rotating drum including a shell having an inner peripheral surface, a central flange, and a radial support extending at least generally radially from the flange to the shell; and (D) a scraper that is supported on the casing and that is located adjacent an interface between the radial support and the shell, the scraper being configured to scrape accumulated materials from the interface.

2. The compaction roller machine as recited in claim 1, wherein the radial support is formed from a plurality of spokes extending from the flange to the inner peripheral surface of the shell, the interface being formed at a location in which one of the spokes meets the shell.

3. The compaction roller machine as recited in claim 2, wherein the interface is formed from a reinforcing gusset leading from an inner axial surface of an outer radial end portion of the spoke to the inner peripheral surface of the shell.

4. The compaction roller machine as recited in claim 3, wherein the scraper has a scraping surface extending generally axially over the gusset and an adjacent portion of the shell when the gusset is located at a point of closest approach to the scraper.

5. The compaction roller machine as recited in claim 4, wherein the scraper has an outer scraping surface that extends generally radially of the roller assembly and that is located axially closely adjacent an inner axial surface of each spoke when the spoke is located at a point of closest approach to the scraper during drum rotation.

6. The compaction roller machine as recited in claim 1, wherein the scraper is located within 30 degrees of a bottom of the roller assembly.

7. The compaction roller machine of claim 1, wherein the scraper is generally V-shaped, having an apex that is located relatively remote from the interface and having first and second legs extending toward the interface.

8. The compaction roller machine as recited in claim 1, further comprising a roller assembly drive motor and an exciter assembly drive motor, each of which is mounted on an exterior surface of the casing, and each of which is supplied with hydraulic fluid via hydraulic hoses connected to fittings located thereon.

9. The compaction roller machine of claim 1, wherein the machine has front and rear roller assemblies, each of which has a scraper located therein adjacent an interface between an associated shell and an associated radial support.

10. The compaction roller machine of claim 9, wherein the rotary compaction machine is a vibratory trench roller having an articulated frame including front and rear subframes which can pivot relative to one another, and wherein each of the subframes is supported on a respective one of the roller assemblies.

11. The compaction roller machine of claim 1, wherein the roller assembly has a split roller assembly having first and second drums arranged coaxially with one another on opposite sides of a longitudinal centerline of the machine, and wherein the scraper is located in the first drum near an outboard end of the first drum.

12. A vibratory trench roller comprising:

(A) an articulated chassis having first and second subframes that can pivot relative to one another;

(B) a prime mover that is supported on the first subframe; and (C) first and second roller assemblies, each of which is attached to a respective subframe, each roller assembly including a stationary transmission casing, a rotating drum which is driven to rotate by the prime mover and in which the transmission casing is located, the rotating drum including a shell having an inner peripheral surface, a central flange, and a plurality of spokes extending from the flange to the inner peripheral surface of the shell, a roller assembly drive motor and an exciter assembly drive motor, each of which is mounted on an exterior surface of the transmission casing within the drum, each of the drive motors being supplied with hydraulic fluid connected thereto via fittings located thereon, a scraper that is supported on the transmission casing and that is located adjacent an interface between each spoke and the shell at a point of closest approach of the spoke to the scraper during drum rotation, the scraper being configured to scrape accumulated materials from the interface.

13. The vibratory trench roller of claim 12, wherein at least one of the roller assemblies has a split roller assembly having first and second drums arranged coaxially with one another on opposite sides of a longitudinal centerline of the machine, and wherein the scraper is mounted in the first drum near an outboard end of the first drum.

14. The vibratory trench roller of claim 12, wherein the interface associated with each spoke is formed from a reinforcing gusset leading from an inner axial surface of an outer radial end portion of the spoke to the inner peripheral surface of the shell, and wherein the scraper has a scraping surface extending generally axially over the gusset and an adjacent portion of the shell when the gusset is located at a point of closest approach to the scraper.

15. The vibratory trench roller of claim 12, wherein the scraper has an outer scraping surface that extends generally radially of the roller assembly and that is located axially closely adjacent an inner axial surface of each spoke when the spoke is located at a point of closest approach to the scraper during drum rotation.

16. The vibratory trench roller of claim 12, wherein the scraper is located within 30 degrees of a bottom of the roller assembly.

17. A method comprising:

(A) supporting a frame of a compaction roller machine on a roller assembly, the compaction roller machine comprising a frame supporting a prime mover, a roller assembly including a stationary casing and a drum having a flange, a shell having an inner peripheral surface, and a radial support extending at least generally radially from the inner peripheral surface of the shell to the flange;

(B) under power of the prime mover, driving the drum to rotate to compact soil and, as the drum rotates, scraping materials accumulated on an interface between the radial support and the inner peripheral surface, the scraping being performed by a stationary scraper that is supported on the casing.

18. The method of claim 17, wherein the radial support includes a spoke having a gusset that forms the interface, and wherein the interaction occurs between the scraper and the gusset.

19. The method of claim 18, further comprising, during the interaction, grinding or crushing pieces of material between the scraper and the interface.

20. The method of claim 17, further comprising directing scraped materials out of the roller assembly through an entrance gap formed between an inner axial end of the shell and a stationary drum support that is connected to the frame.

* * * * *